US006402099B1

(12) United States Patent
Hughes

(10) Patent No.: US 6,402,099 B1
(45) Date of Patent: Jun. 11, 2002

(54) NURSING BOTTLE HOLDER

(76) Inventor: Troy A. Hughes, 905 Liberty St., Alton, IL (US) 62002

( * ) Notice: Subject to any disclaimer, the term of this patent is extended or adjusted under 35 U.S.C. 154(b) by 0 days.

(21) Appl. No.: 09/710,179

(22) Filed: Nov. 10, 2000

(51) Int. Cl.[7] ..... A47D 15/00
(52) U.S. Cl. ..... 248/106; 248/102
(58) Field of Search ..... 248/102, 103, 248/104, 105, 106, 311.2; 224/148.4

(56) References Cited

U.S. PATENT DOCUMENTS 1,590,227 A * 6/1926 Britton ..... 248/103
2,526,121 A * 10/1950 Curry et al. ..... 248/102
2,552,844 A * 5/1951 Clinehens ..... 248/106
2,880,950 A 4/1959 Williams et al. ..... 248/102
3,117,759 A 1/1964 Herer
3,627,244 A * 12/1971 Nicholas ..... 248/103
4,405,106 A * 9/1983 Adler ..... 248/102

* cited by examiner

*Primary Examiner*—Leslie A. Braun
*Assistant Examiner*—Gwendolyn Baxter
(74) *Attorney, Agent, or Firm*—Polster, Lieder, Woodruff & Lucchesi, L.C.

(57) ABSTRACT

A bottle holder has a torso-engaging part, generally held in place by a strap around the person by whom the bottle holder is being used, a first segment hinged to the torso-engaging part, a second segment connected to the first segment in such a way as to be extendable from the first segment and selectively clamped in an extended position, and a bottle gripping segment hingedly connected to the second segment. In the preferred embodiment, a supplemental support is carried by the first segment, the second segment is carried by rods spring biased to slide within passages in the first segment to return to a non-extended position when the retaining structure are released, and the bottle gripping segment is adapted to receive bottles of different diameters.

18 Claims, 4 Drawing Sheets

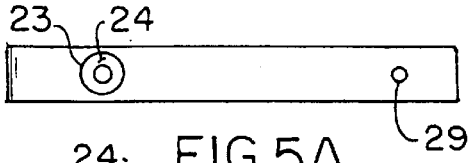
FIG.5A
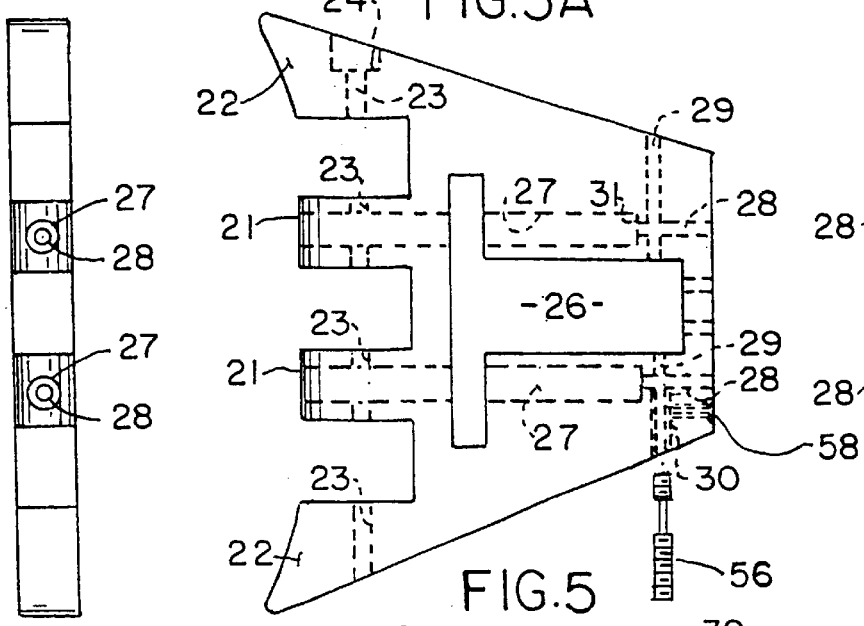
FIG.5
FIG.5B
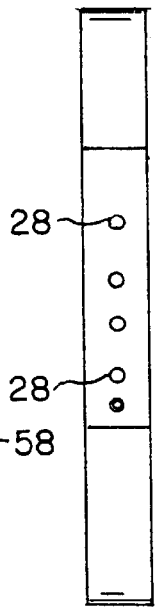
FIG.5C
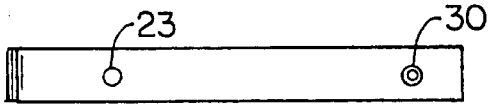
FIG.5D
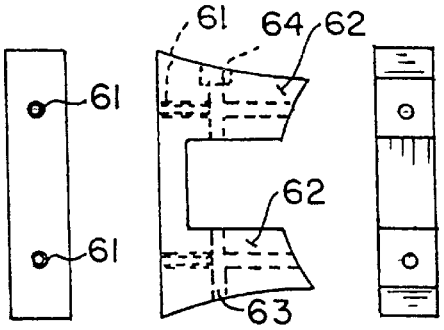
FIG.6A FIG.6 FIG.6B
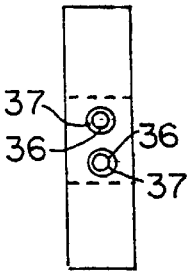
FIG.7A
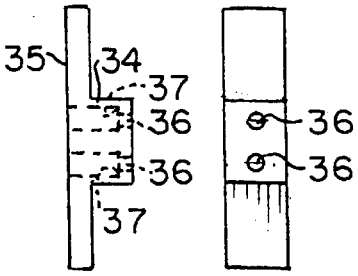
FIG.7 FIG.7B
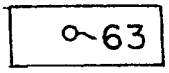
FIG.6C
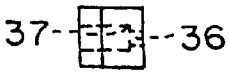
FIG.7C

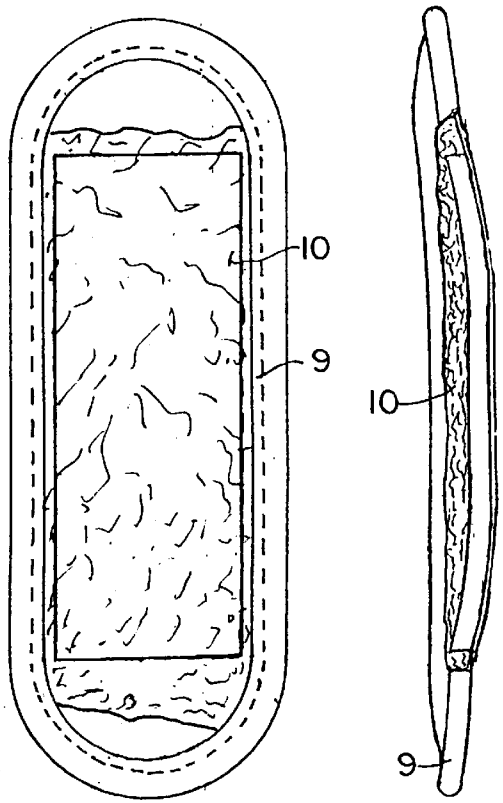
FIG.10C
FIG.10B
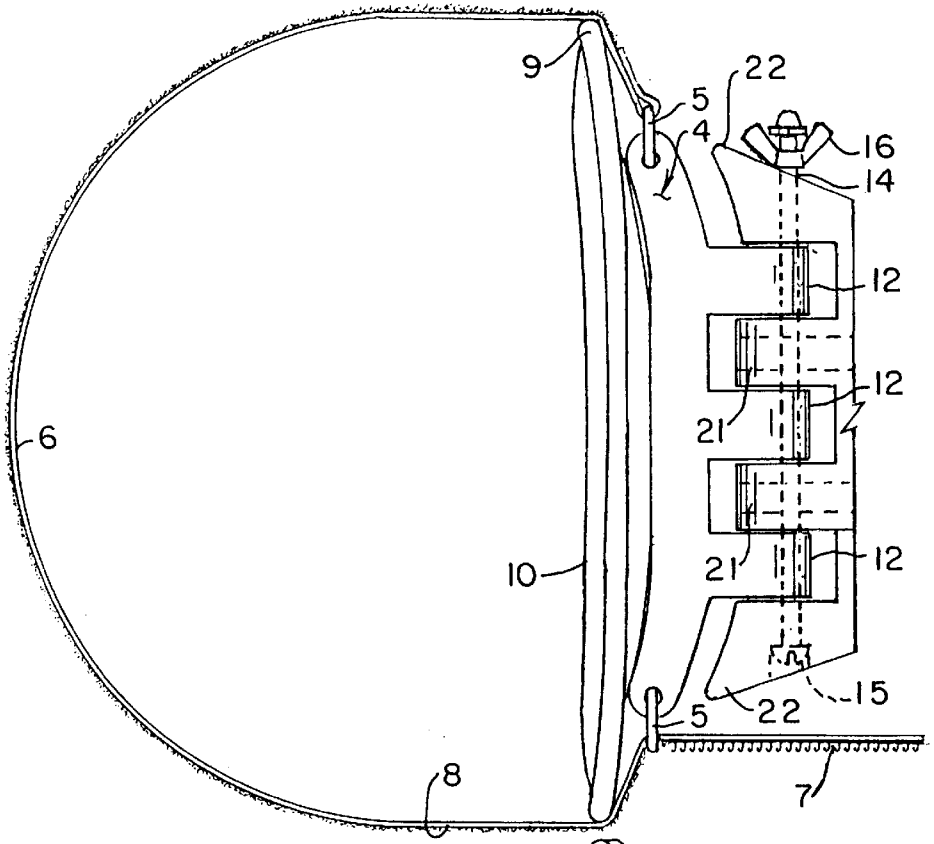
FIG.10
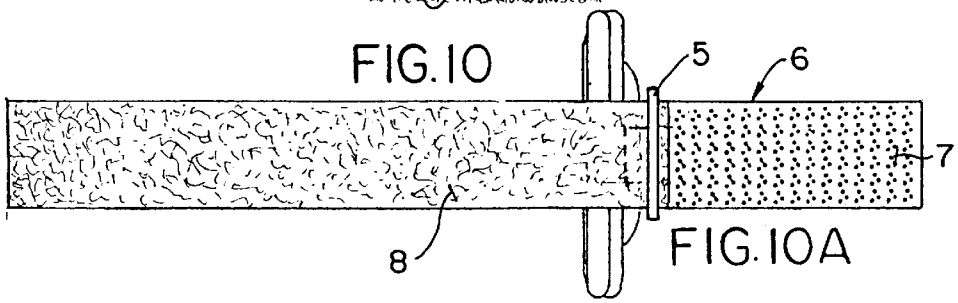
FIG.10A

NURSING BOTTLE HOLDER

CROSS REFERENCE TO RELATED APPLICATIONS

Statement Regarding Federally Sponsored Research or Development

Not Applicable.

BACKGROUND OF THE INVENTION

The bottle holder of this invention is adapted to use by a person, usually a baby three to six months old, either lying on its back or sitting up, either on its own or being held. As used by an invalid or someone who wants to drink while using both hands for some other purpose, it will ordinarily be used in a situation in which the torso of the user is generally upright. When used by a small baby, the baby can push the bottle away if the baby does not want to feed, but can be retrieved by the baby when it does want the bottle. It is easy to adjust, both heightwise and angularly while connected to the baby, both for the convenience of the baby and for avoiding air pockets in the bottle as the level of liquid in the bottle gets low.

In any event, the device of this invention permits the use of one or both hands for purposes other than holding a bottle. The problem of providing such a holder has been addressed for many years. See, for example, U.S. Pat. Nos. 2,880,950, 3,117,759 and 4,405,106. An object of this invention is to provide a holder more adaptable to and versatile in use than holders known heretofore.

BRIEF SUMMARY OF THE INVENTION

In accordance with this invention generally stated, a bottle holder is provided with a torso-engaging part, a first segment hingedly connected to the torso-engaging part, a second segment mounted on the first segment in such a way as to be selectively extendable from the first segment, and a bottle gripping segment hingedly connected to the second segment. The hinged segments are arranged to be held in any desired angular position, within limits. In the preferred embodiment, the first and second segments are made of a plastic of sufficient resiliency to permit knuckles formed in the plastic to be squeezed against knuckles with which they are interleaved, frictionally to hold the segments in the desired angular position. The second segment is provided with rods extending into passages in the first segment. Helical springs bias the rods toward unextended position. A spring biased prop or rest is hingedly mounted on the first segment, the springs serving the double function of holding the rest in place on the first segment and cushioning the rest as it engages the chest of the wearer. The bottle gripping segment in the preferred embodiment has a fixed arcuate part hinged to the second segment and a movable arcuate part hinged to one end of the fixed arcuate part and spring biased in a direction toward the first arcuate part, so as frictionally to engage the bottle, and to accommodate different sizes of bottles.

BRIEF DESCRIPTION OF THE SEVERAL VIEWS OF THE DRAWINGS

In the drawing

FIG. 5 is a top plan view of a first segment, without a rest shown in FIG. 1;

FIG. 5A is a view in side elevation viewed from top to bottom of FIG. 5;

FIG. 5B is a view in end elevation from left to right of FIG. 5;

FIG. 5C is a view in end elevation viewed from right to left of FIG. 5;

FIG. 5D is a view in side elevation viewed from bottom to top of FIG. 5;

FIG. 6 is a top plan view of a second segment as shown in FIG. 1;

FIG. 6A is a view in end elevation viewed from left to right of FIG. 6;

FIG. 6B is a view in end elevation viewed from right to left of FIG. 6;

FIG. 6C is a view in side elevation of FIG. 6;

FIG. 6D is a view in side elevation of a rod extending between the first and the second segments;

FIG. 6E is a view in side elevation of a spring to be mounted on the rod shown in FIG. 6D;

FIG. 6F is a view in side elevation of a stop sleeve to be mounted on the rod shown in

FIG. 6D;

FIG. 6G is a view in end elevation of the sleeve shown in FIG. 6F;

FIG. 7 is a top plan view of a T-shaped member of a rest assembly as shown in FIG. 1;

FIG. 7A is view in end elevation viewed from left to right of FIG. 7;

FIG. 7B is a view in end elevation viewed from right to left of FIG. 7;

FIG. 7C is a view in side elevation of FIG. 7;

FIG. 7D is a in veiw side elevation of a bolt in the rest assembly shown in FIG. 1;

FIG. 7E is a view in side elevation of a helical spring mounted on bolt of FIG. 7D;

FIG. 7F is a view in end elevation taken in the direction from left to right of a hinge block of rest assembly shown in FIG. 1;

FIG. 7G is a top plan view of the hinge block shown in FIG. 7F;

FIG. 7H is a view in end elevation viewed from right to left of the block shown in FIG. 7G;

FIG. 7I is a view in side elevation of FIG. 7G;

FIG. 8 is a top plan view of a bottle gripping segment as shown in FIG. 1;

FIG. 8A is a view in side elevation viewed from top to bottom of FIG. 8;

FIG. 8B is a view in end elevation viewed from left to right of FIG. 8;

FIG. 8C is a view in end elevation viewed from right to left of FIG. 8;

FIG. 8D is a view in side elevation viewed from bottom to top of FIG. 8;

FIG. 9 is a top plan view of a torso-engaging part of a device shown in FIG. 1;

FIG. 9A is a view in side elevation of FIG. 9;

FIG. 9B is a view in end elevation of FIG. 9 viewed from left to right;

FIG. 9C is a view in end elevation viewed from right to left of FIG. 9;

FIG. 9D is a view in side elevation from bottom to top of FIG. 9;

FIG. 10 is a fragmentary view top plan view of a hinge element of a torso-engaging part with a strap;

FIG. 10 is a view in end elevation viewed from left to right of FIG. 10;

FIG. 10B is a fragmentary view in end elevation of the torso-engaging part, without the strap, showing a pressure distributing plate and, partly broken away, a soft padding; and FIG. 10C is a view in side elevation of FIG. 10B.

PREFERRED EMBODIMENT OF THE INVENTION

Figure 1:
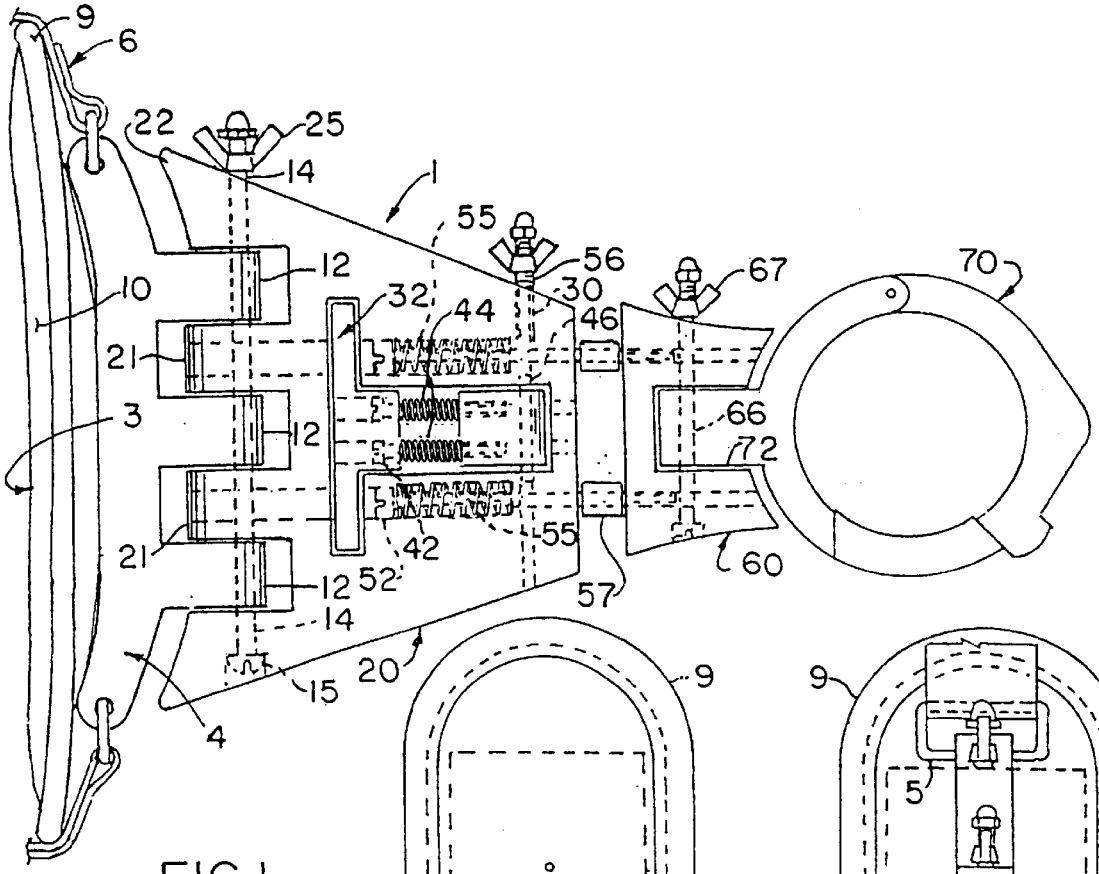
FIG. 1 is a top plan view of one embodiment of bottle holder of this invention, partly broken away.
Figure 3:
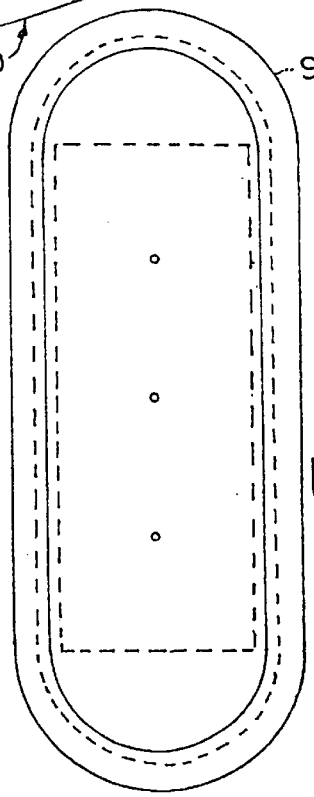
FIG. 3 is a view in end elevation of the device shown in FIG. 1 viewed from left to right.
Figure 4:
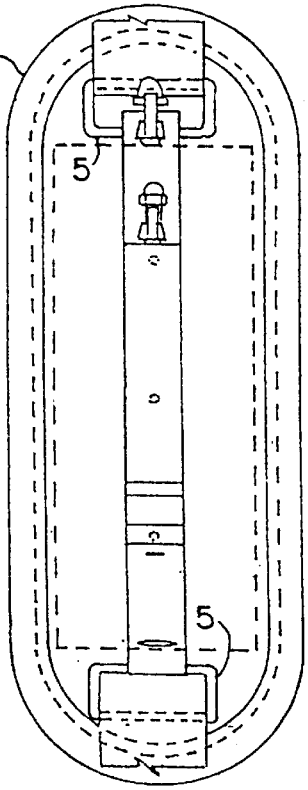
FIG. 4 is a view in end elevation viewed from right to left.
Figure 2:
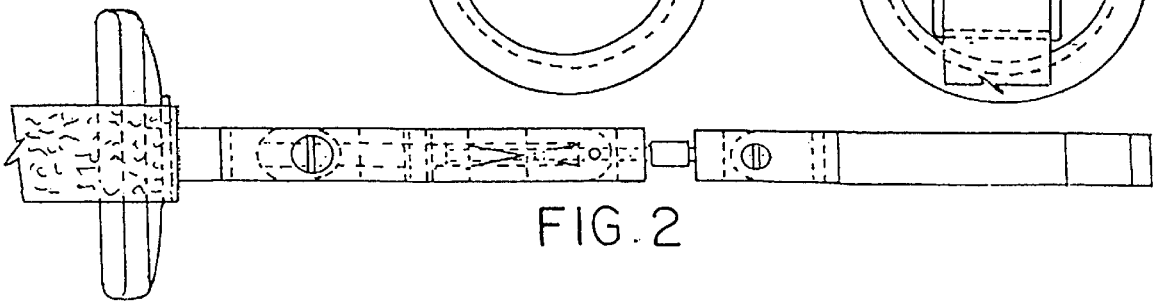
FIG. 2 is a view in side elevation of the device shown in FIG. 1.

Referring now to the drawings for one illustrative embodiment of bottle holder of this invention, reference numeral 1 indicates the assembled device best shown in FIG. 1. The device 1 is made up of four main components, a torso-engaging part assembly 3, a first segment 20, a second segment 60, and a bottle gripping segment 70.

The torso-engaging part 3 is, in this embodiment, made up of three elements, a hinge section 4, a backing plate 9, and a soft pad 10. In the embodiment shown in FIGS. 1–5, the hinge section 4 has three knuckles 12 with aligned holes 23, through which a pintle 14 extends when the holder is assembled. The hinge section 4 also has passages 11 through two ends, to accommodate metal, flattened rings 5 to one of which a closed end of a strap 6 is connected, and through the other of which of a free end of the strap 6 is passed. The outer end of the strap 6 is provided with a hook patch 7, which selectively engages a loop, patch 8 on the same side, to permit the length of the strap around a person's torso to be adjusted to fit snuggly but comfortably.

The backing plate 9 spreads the pressure of the strap over a greater area of the torso of the user, and the resilient soft pad 10 adds to the comfort, accommodating slightly different contours of the chest of the person using the device and serving as a cushion.

The first segment 20 has two intermediate knuckles 21, extending between the three knuckles 12 of the hinge part 4, and two outside knuckles 22 extending along outer faces of the outer knuckles 12. The knuckles 21 and 22 have aligned passages 23 through them. One of the passages 23 opening to the exterior of a knuckle 22 is counterbored has shown particularly in FIGS. 1 and 5, to provide a seat 24 to receive a head 15 of the pintle 14. The other end of the pintle 14 is threaded to take a wing nut 25.

The first segment 20 is made in the form of a regular trapezoid, the knuckles 21 and 22 being along the base of the trapezoid. A T-shaped opening 26 with a wide stem section and a relatively narrow crossbar section is positioned centrally of the transverse direction of the first segment. For purposes of assembly, two passages 27 extend through the knuckles 21, through the bar part of the opening 26 and short of the upper end of the segment 20, flanking the stem portion of the opening 26, all is shown in FIG. 5. Smaller passages 28, coaxial with the openings 27, extend through the outer end of the segment 20 and into the passages 27. A transverse passage 29 extends from one edge of the segment 20, parallel to the outer edge of the segment and intersecting one of the passages 28, opening into the stem of the opening 26, and extending a short distance beyond the opening 26, as shown in FIG. 5. A passage 30 is shown as aligned with the passage 29. The passage 30 is internally threaded.

The opening 26 serves as a seat for a rest assembly 32. The rest assembly 32 is made up of a T-shaped chest engaging member 33 with a short but wide stem 34 and a crossbar 35. The stem 34 has in it passages 36, having an enlarged part extending through the face of the crossbar 35, and a part of less diameter extending through the face of the stem part 34, as shown in FIGS. 1, 7, and 7C to define an annular shoulder 37. A pivot block 39 has a rounded outer end. Two internally threaded passages 41 extend from a flat end opposite the rounded outer end. The passages 41 are aligned with the passages 36. Bolt 42, with a head 43, is slideably mounted in the passages 30, the head 43 seating on the seat 37, and a threaded end of the bolt 43 screwing into the internally threaded passages 41 of the pivot block 39. A compression spring 44 is mounted on the shank of the bolt 42, as shown particularly in FIG. 1. When the head 43 of the bolt 42 is seated against the shoulder, the bias of the spring holds the rest 33 against a facing surface of the bar part of the opening 26, as shown in FIG. 1, to hold the rest assembly in place. When the rest assembly is swung out around a pivot pin 46, seated in the passage 29, the rest 33 can be moved against the bias of the spring toward the pivot block 39.

Bolts 50, each with a head 51, and a long shank 52 with a threaded portion 53 at its end, are slideably mounted in the passages 27, the shanks extending through the passages 28. Compression springs 55 are mounted on the shanks 52, between the head 51 and the seat 31 formed at the junction of the passages 27 and 28. The shanks 52 of the bolts 50 pass through sleeve-stops 57, and are threaded into internally threaded passages 61 in the second segment 60, as shown in FIG. 1. A setscrew 56 is threaded into the internally threaded passage 30, and is selectively tightened against one of the shanks or rods 52 to hold the rods in a selected extended position. The setscrew 56 has a neck intermediate two threaded sections, as shown in FIG. 5. A screw 58 projects into the neck area to ensure that the setscrew 56 is not inadvertently backed out of the passage 30. As a loose part, the setscrew might pose a hazard to a baby. The springs 55 permit substantial movement of the bolts, hence the second segment 60 away from the first segment 20, the spring 55 serving only to restore the second segment to non-extended position against an end of the sleeve-stops 57, when the set screw 56 is loosened.

Beyond the threaded portion of the passage 61, the passage 61 is intersected by transverse passages 63 counterboard on one side of the segment to provide a seat 64 for the head of a pintle 66. The pintle 66 is threaded at the end opposite the head, to receive a wing nut 67. The pintle 66 extends through a passage 71 in a knuckle 72 of the bottle gripping segment 70.

The second segment 60 is formed with spaced knuckles 62. The knuckle 72 extends between the knuckles 62 in close proximity to them. The knuckles 62 are sufficiently resilient that when the wing nut 67 is screwed down, the knuckles 62 will engage the side edges of the knuckle 72 tightly.

Figures 6D, 6E, 6F, 6G, 7D, 7E, 7F, 7G, 7H, 7I, 8A, 8B, 8C, 8D, 9, 9A, 9B, 9C, 9D:
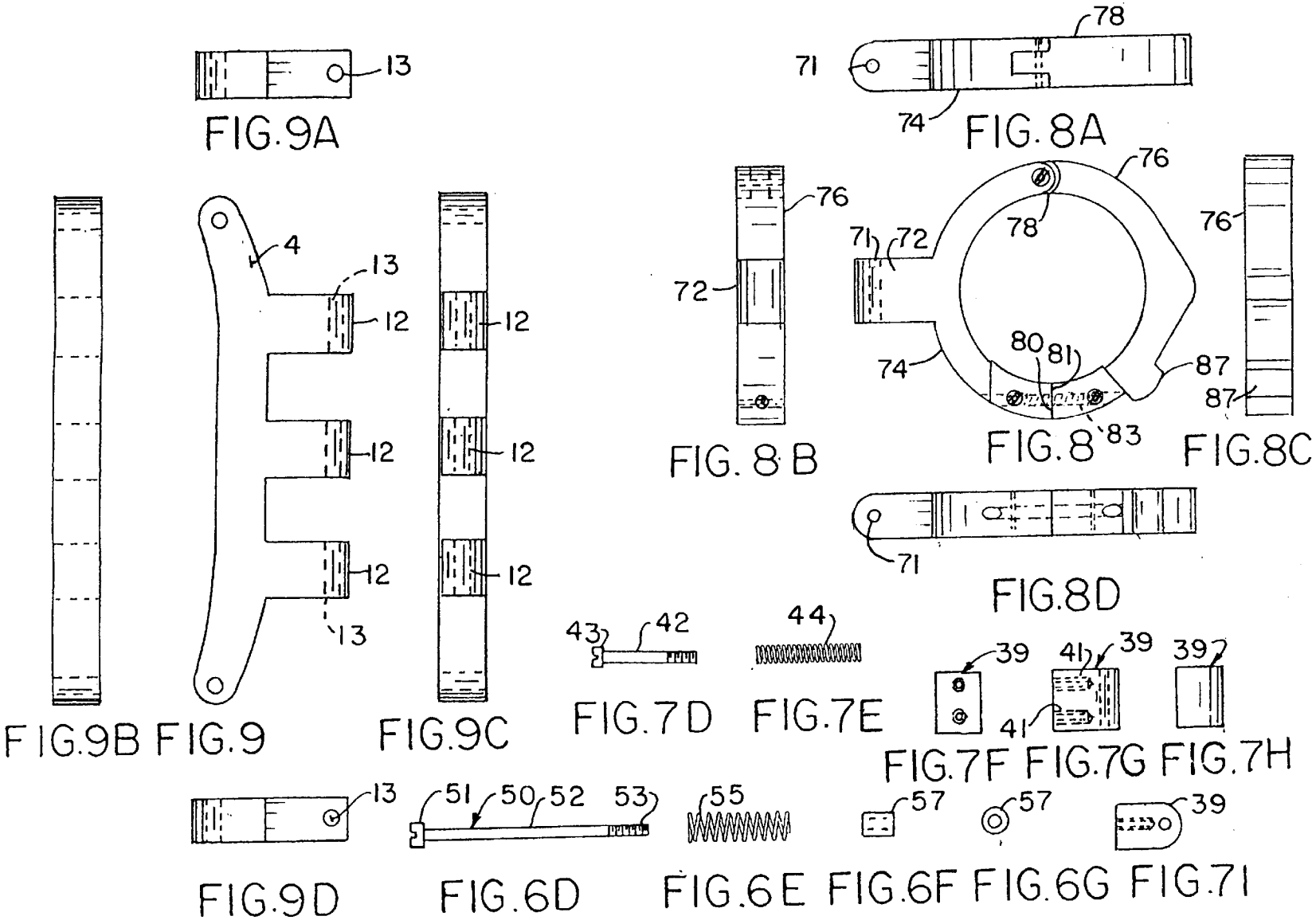

A fixed arcuate section 74 of the segment 70 is integral with the knuckle 72. A movable arcuate section 76 is pivotally connected by a hinge pin 78 to one end of the arcuate section 74, as shown particularly in FIGS. 8 and 8A. Ends 80 and 81 of the arcuate sections, opposite the hinge pin 78, are biased into abutting position by spring 83, one end of which is connected to the end 80 and the other, to the end 81, as shown in FIG. 8. The ends are preferably shielded by a sleeve 85 to protect the fingers of the user. The spring 83 permits the moveable arcuate section 76 to be opened to admit various sizes of bottle, and in any event, to hold the bottle securely against movement once within the compass of the arcuate sections. A thumb boss 87 is provided to facilitate opening of the section 76.

Merely by way of illustration, as a baby bottle holder, the device can be 9 inches long from the underside of the hinge section 4 to the outermost edge of the bottle gripping segment 70 when the second segment is not extended, and 9⅞ inches when the second section is extended. Hinge section 4, first second segments, 20 and 60, and bottle gripping sections 70 can all be made ½ inch thick, of a suitable plastic such as polyurethane, solid or foamed. If foamed, the sections can be made with slick outer surfaces, the foam constituting a core, to make cleaning easy, but reducing the weight. The hinge section 4 can be made 5¼ inches long and the backing plate 9, 6⅞ inches long. The knuckles can all be fitted closely, so that little pressure is required to hold them in any desired position. These dimensions can be varied to accommodate the persons by whom the device is to be used.

Numerous variations in the construction of the bottle holder of this invention, within the scope of the appended claims, will occur to those skilled in the art in the light of the foregoing disclosure. For example, the numbers of knuckles can be varied. Knuckles can be spaced enough to accommodate Belleville disc springs or their equivalent inserted between the knuckles of the segments, either in lieu of or as a supplement to the wing nuts. The segments contiguous the wing nuts can either be formed with a flat surface perpendicular to the passages, or formed with a boss that provides a flat surface for the wing nuts, perpendicular to the passages. Knurled knobs or the like can be substituted for the wing nuts. The strap can be made in two parts, each with a closed loop around a ring, and with the hook loop patches on opposite sides of the ends of each strap, to permit adjustment. The arcuate parts of the bottle holder can be coated on the inside with a nonslip material. It will be observed in FIGS. 1 and 5, that passages between the outer edge of the first segment and the slot 26 can be provided. These may house spring detents or spring-biased friction elements to bear against the rounded end of the block 39 to hold the rest in any desired position. If a single rod or tube is substituted for the two rods between the second segment and the bottle holding segment, the bottle holding segment can be oriented angularly from the second segment, to permit further accommodation. A ball and socket joint, mounted on a cross bar between the two rods of the preferred embodiment, or on a single rod, can also be employed between the second segment and the bottle holding segment. Various other plastics such as polyethylene or polypropylene, for example, can be used, either in solid or in foamed form. These variations are merely illustrative.

Having thus described the invention, what is claimed and desired to be secured by Letters Patent is:

1. A bottle holder comprising a torso-engaging part elongated in a direction adapted to be transverse to the body of a user, at least one knuckle, integral with said torso-engaging part and oriented in the long direction of said elongated part and oriented in the long direction of said elongated part; a first flat segment with at least one knuckle hingedly connected to said torso-engaging part knuckle and means for maintaining said first flat segment in a desired angular relation to said torso-engaging part; a second flat segment operably connected to said first flat segment and means for adjustably extending said second flat segment from said first flat segment; and a bottle gripping segment hingedly attached to said second segment, said bottle gripping segment having means for selectively releasably gripping a bottle.

2. The bottle holder of claim 1 wherein the first segment is made of resilient plastic, has at least one knuckle interleaved with knuckles on said torso-engaging part and a pintle, extending through said interleaved knuckles and constructed selectively to move at least two of said knuckles to squeeze at least one knuckle between them frictionally to hold said first segment in said desired angular relation.

3. The bottle holder of claim 1 including a T-shaped support seated in said first segment and adopted to swing out to engage the chest of an infant using the holder.

4. The bottle holder of claim 3 wherein the T-shaped support is spring biased in a direction toward the chest of the infant.

5. The bottle holder of claim 1 wherein said second segment has legs extending slidably into opening in said first segment and means extending into said opening and engaging at least one of said legs for holding said legs in a desired position.

6. The bottle holder of claim 1 wherein the bottle gripping segment is flat, substantially coplanar with said second section; and includes at least one knuckle, the second section includes at least one knuckle, the bottle gripping segment knuckle being rotatable relative to the second section knuckle, a pintle, extending through said knuckles and adapted to squeeze one knuckle against a contiguous knuckle to hold said knuckles in a desired angular relation to one another.

7. The bottle holder of claim 1 wherein the bottle-gripping segment comprises two arcuate parts, one fixedly connected to a knuckle contiguous a knuckle of said second segment and the other, being hingedly movably connected to said fixedly connected part at one end and spaced from said fixedly connected part at a free end, and biasing means urging said hingedly connected part toward said fixed part to receive and frictionally to hold a bottle between said two arcuate parts.

8. The bottle holder of claim 7 wherein said biasing means is a helical spring fastened at one end to said fixed arcuate part and at another end to said hinged movable arcuate part.

9. The bottle holder of claim 8 including a sleeve around said helical spring.

10. A bottle holder comprising a torso-engaging part; a first segment hingedly attached to said torso-engaging part and means for maintaining said first segment in a desired angular relation to said torso-engaging part; a second segment operably connected to said first segment and means for adjustably extending said second segment from said first segment; and a bottle gripping segment hingedly attached to said second segment, said bottle gripping segment having means for selectively releasably gripping a bottle, said torso-engaging part including a pad of soft material immediately adjacent the torso of a person using the holder.

11. The bottle holder of claim 10 wherein the first segment is made of resilient plastic, has at least one knuckle interleaved with at least one knuckle on said torso-engaging part and a pintle, extending through said interleaved knuckles and constructed selectively to move at least two of said knuckles to squeeze them together frictionally to hold said first segment in said desired angular relation.

12. The bottle holder of claim 10 including a T-shaped support seated in said first segment and adopted to swing out to engage the chest of an infant using the holder.

13. The bottle holder of claim 10 wherein the T-shaped support is spring biased in a direction toward the chest of the infant.

14. The bottle holder of claim 10 wherein said second segment has legs extending slidably into opening in said first segment and means extending into said opening and engaging at least one of said legs for holding said legs in a desired position.

15. The bottle holder of claim 10 wherein the bottle gripping segment includes at least one knuckle, the second section includes at least one knuckle, one of said knuckles being rotatable relative to the other, a pintle, extending through said knuckles and adapted to squeeze one knuckle against a contiguous knuckle to hold said knuckles in a desired angular relation to one another.

16. The bottle holder of claim 10 wherein the bottle-gripping segment comprises two arcuate parts, one part fixedly connected to a knuckle contiguous a knuckle of said second segment and the other part hingedly connected to said fixedly connected part at one end and movable from a position abutting an end of said fixedly connected part to a position spaced from said fixedly connected part at a free end, and biasing means urging said hingedly connected part toward said fixed part to receive and frictionally to hold a bottle between said two arcuate parts.

17. The bottle holder of claim 16 wherein said biasing means is a helical spring fastened at one end to said fixed arcuate part and at another end to said hinged movable arcuate part.

18. The bottle holder of claim 17 including a sleeve around said helical spring.

* * * * *

UNITED STATES PATENT AND TRADEMARK OFFICE

CERTIFICATE OF CORRECTION

PATENT NO. : 6,402,099 B1
DATED : June 11, 2002
INVENTOR(S) : Troy A. Hughes

It is certified that error appears in the above-identified patent and that said Letters Patent is hereby corrected as shown below:

Column 3,
Line 10, replace "Fig. 10" with -- Fig. 10A --
Line 36, replace "loop, patch" with -- loop patch --

Signed and Sealed this

Thirteenth Day of May, 2003

JAMES E. ROGAN
*Director of the United States Patent and Trademark Office*